United States Patent [19]

Shin et al.

[11] Patent Number: 4,963,456

[45] Date of Patent: Oct. 16, 1990

[54] ELECTROPHOTOGRAPHIC TONER

[75] Inventors: Masaaki Shin, Fujisawa; Nobuhiro Hirayama; Keiichi Ishikawa, all of Yokohama; Akira Misawa, Kamakura, all of Japan

[73] Assignee: Mitsui Toatsu Chemicals, Incorporated, Tokyo, Japan

[21] Appl. No.: 320,301

[22] PCT Filed: Sep. 30, 1987

[86] PCT No.: PCT/JP87/00718

§ 371 Date: Feb. 22, 1989

§ 102(e) Date: Feb. 22, 1989

[87] PCT Pub. No.: WO89/00717

PCT Pub. Date: Jan. 26, 1989

[30] Foreign Application Priority Data

Jul. 10, 1987 [JP] Japan ..... 62-171087

[51] Int. Cl.[5] ..... G03G 9/08; G03G 11/00

[52] U.S. Cl. ..... 430/109; 430/137; 526/934

[58] Field of Search ..... 430/109, 137

[56] References Cited

U.S. PATENT DOCUMENTS 4,246,332 1/1981 Tanaka ..... 430/109

4,737,433 4/1988 Rimai ..... 430/111

*Primary Examiner*—J. David Welsh

*Attorney, Agent, or Firm*—Oblon, Spivak, McClelland, Maier & Neustadt

[57] ABSTRACT

Electrophotographic toner is provided which contains 30–80% by weight of a polymer per total weight of a resin included in the toner, said polymer is obtained by continuously feeding a vinyl monomer, a polymerization initiator and a solvent into a system of 190°–230° C. to conduct polymerization under a liquid state, and said polymer is a vinyl polymer having a number average molecular weight of 1,000–5,000 and a glass transition temperature of 40°75° C. The preparation method of the electrophotographic toner is also provided. The toner is excellent in the fixing ability at high duplication speed and lower temperatures.

16 Claims, No Drawings

ELECTROPHOTOGRAPHIC TONER

FIELD OF THE INVENTION

The present invention relates to an electrophotographic toner powder for use in the development of an electrostatic image in electrophotography, and more particularly relates to an electrophotographic dry toner which exerts excellent lower temperature fixing ability in a hot-roll copying method.

BACKGROUND OF THE TECHNIC

The electrophotographic toner is conventionally composed of a resin composition, coloring agent which contains pigments or dyestuffs, control agents, wax and the like. Synthesic or natural resin is used for the resin composition singly or as a suitable mixture. A relatively high molecular weight styrene containing polymer is generally used as admixture with a relatively low molecular weight styrene containing polymer in a suitable proportion. The composition and thermal properties of the styrene containing polymer employed are important factors deciding the toner characteristics, and currently their improvement is strongly required.

Many kinds of fixation method which called hot-roll process are employed in the electrophotographic copying machines and printers. In this method, toner particles which were electrostatically transferred on copying papers are passed through heated press rolls, thereby the particles are melted and fixed on the paper. Copying machines have recently been developed for conducting duplication at a high rate with a low energy fixation. Conventional toner, however, is not always satisfactory for the performance of these machines and printers by the following reason. The heat quantity transferred from the hot rolls to the toner particles at high duplication speed is less than at low duplication speed. A remarkable decrease in the surface temperature of hot rolls is also caused by the increase in heat removal to the copying papers, which leads to insufficient fusion and deteriorated fixation of the toner particles. Besides the copying machines fitted with various auxiliary devices are required to operate all of these devices within a limited consumption of electricity. Since the proportion of electrical consumption for heating the rolls is very high in the total consumption, it is strongly required to lower the temperature of hot rolls. The conventional toner, however, cannot perform satisfactory melting and adhesion to the copying papers at lower surface temperatures of the hot rolls. Therefore it has been strongly desired to develop the toner which exhibits sufficient fixing ability with by supplying a smaller quantity of heat. As a countermeasure to this problem, there is a method for satisfactorily conducting the fixation under conditions of high speed and lower temperature conditions by lowering the softening temperature or melt viscosity of the resin constituting the toner particles. That is, the toner melting at the lower temperature can be prepared by adjusting the mixing ratio of the resin. This method, however, increases the proportion of low molecular weight styrene containing resin and drastically decreases the melt viscosity of resin at high temperatures. As a result, the toner particles which were melted and pressed on a copying paper by the hot rolls at the fixation stage are partly are transferred and left on the hot roll surface when the paper was removed from the rolls. The attached toner on the roll surface is pressed again on the next paper, which is so-called "offset phenomenon". The offset phenomenon causes a serious disadvantage that the copying papers are contaminated and good images cannot be obtained.

Besides the resin having a low softening temperature can be prepared by controlling the monomer composition which constitutes the resin. The toner derived from such low temperature softening resin, however, causes mutual adhesion of the toner particles by pressure during the storage. In the extreme cases, the toner is liable to occur so-called "blocking" phenomenon which leads to whole coagulation of the toner. Particularly in the case of using the low molecular weight styrene containing resin as a low temperature softening component, blocking resistance drastically deteriorates and causes severe problems in actual application.

The resin which is free from the blocking phenomenon and moreover has a low softening temperature can be prepared by similarly reducing molecular weight of the low molecular weight styrene containing polymer which constitutes the resin. Relatively large amount of a polymerization initiator, however, is uneconomically required in order to obtain such low molecular weight styrene containing polymer. Furthermore, a large amount of relatively high-polar impurities such as residue of the polymerization initiator is supposed to contaminate the toner. Thus frictional charge of the toner is extremely labilized and it becomes difficult to obtain sharp, clear and good images over a long period.

Besides the low molecular weight styrene containing polymer can also be obtained by using a small amount of polymerization initiator in combination with a chain transfer agent such as mercaptan. The toner containing a low molecular weight polypropylene (Japanese Patent Publication No. 3304/1977) and the toner obtained by using $\alpha,\beta$-unsaturated ethylene polymer having a broad molecular weight distribution, e.g. weight average molecular weight (Mw)/number average molecular weight (Mn)=3.5–40, as the toner resin (Japanese Patent Publication No. 6895/1980) are also known.

Besides the toner containing a vinyl polymer or its mixture which has at least one peak value in the respective region of $10^3-8\times10^4$ and $10^5-2\times10^6$ in molecular weight (Japanese Patent Laid-open No. 16144/1981, relevant to U.S. Pat. No. 4,499,168) is known.

The toner containing a low molecular weight polymer which has a number average molecular weight of 3,000–50,000 and Mw/Mn of less than 3.5, and an insoluble and infusible polymer (Japanese Patent Publication No. 86558/1983) has also been proposed recently.

The toner obtained from such polymer, however, is still unsatisfactory in charge stability, cannot provide a good image under high relative humidity in particular and results in severe problems in the actual use. In addition, the toner is apt to cause blocking under high relative humidity, and is difficult to employ in practical application.

DISCLOSURE OF THE INVENTION

The object of this invention is to provide an electrophotographic toner which is excellent in the fixing ability at a high duplication speed and a low temperature, capable of obtaining a sharp, clean and good image, and also outstanding in the resistance against blocking and offset.

Another object of this invention is to provide a novel method for obtaining the resin, that is, a useful vinyl polymer component as a binder polymer ingredient, in the preparation of the electrophotographic toner having aforesaid excellent properties.

The present inventors have extensively investigated in order to achieve above objects. Consequently the toner containing the vinyl polymer obtained by the solution polymerization at high temperatures has been found to have excellent properties. Thus the present invention has been completed.

In this invention, the electrophotographic toner contains the polymer in an amount of 30–80% by weight per total weight of the resin in the toner, the polymer is obtained by continuously feeding a vinyl monomer, a polymerization initiator and a solvent into a system maintained at 190°–230° C. to conduct polymerization under a liquid state, and the polymer has a number average molecular weight of 1,000–5,000 and a glass transition temperature of 40°–75° C.

The preparing method of the vinyl polymer which is useful for the preparation of above electrophotographic toner is characterized in reacting the vinyl monomer in a state of solution at 190°–230° C. to obtain the vinyl polymer having a molecular weight of 1,000–5,000 and a glass transition temperature of 40°–75° C.

The above-mentioned toner of this invention is excellent as a one component toner containing magnetic powder or a two component toner employed after mixing with a carrier. The toner is also excellent in the fixing ability at the high duplication speed or under low heat supply, outstanding in the blocking resistance and always capable of providing always stable and good images. Therefore the toner is suitable for the electrophotographic duplication operating, for example, at a high speed of 40–100 sheets/min. and a lower temperature of 130°–140° C.

PREFERRED EMBODIMENTS OF THE INVENTION

The vinyl monomer of this invention refers to styrene alone or a mixture of vinyl monomers containing styrene as a major ingredient. The vinyl monomer other than styrene includes, for example, o-methylstyrene, m-methylstyrene, p-methylstyrene, α-methylstyrene, p-t-butylstyrene, vinylnaphthalene, vinyl chloride, vinyl fluoride, vinyl acetate, acrylonitrile, methacrylonitrile, acrylamide, methacrylamide, acrylic acid, methacrylic acid, fumaric acid, maleic acid, maleic anhydride, itaconic acid, cinnamic acid, crotonic acid, methyl acrylate, ethyl acrylate, n-propyl acrylate, i-propyl acrylate, n-butyl acrylate, i-butyl acrylate, cyclohexyl acrylate, 2-ethylhexyl acrylate, stearyl acrylate, methyl methacrylate, ethyl methacrylate, n-propyl methacrylate, i-propyl methacrylate, n-butyl methacrylate, i-butyl methacrylate, cyclohexyl methacrylate, 2-ethylhexyl methacrylate, stearyl methacrylate, dimethyl fumarate, diethyl fumarate, di-i-propyl fumarate, di-n-butyl fumarate, di-i-butyl fumarate, dimethyl maleate, diethyl maleate, di-i-propyl maleate, di-n-butyl maleate, di-i-butyl maleate, 2-vinylpyridine, 2-vinylpyrrole, N-vinylcarbazole, N-vinylindole and N-vinylpyrrolidone. In the practice of this invention, styrene alone or a mixture of styrene with methacrylic acid and/or methyl methacrylate is particularly preferable among these vinyl monomers. Particularly in consideration of hygroscopic property of the polymer, methacrylic acid, maleic anhydride and cinnamic acid are preferred for use.

The polymerization initiator which is used in this invention is at least one of known radical polymerization initiator which belongs to perester, hydroperoxide, dialkyl peroxide, ketone peroxide, diacyl peroxide, percarbonate, azobis derivative and the like. The initiator includes, for example, t-butyl peroctoate, t-butyl perbenzoate, t-butyl perisobutyrate, t-butyl hydroperoxide, cumene hydroperoxide, di-t-butyl peroxide, t-butyl cumyl peroxide, dicumyl peroxide, methyl ethyl ketone peroxide, methyl isobutyl ketone peroxide, cyclohexanone peroxide, acetyl peroxide, lauryl peroxide, benzoyl peroxide, diisopropyl peroxydicarbonate, bis(4-t-butylcyclohexyl) peroxydicarbonate, 2,2'-azobisisobutyronitrile, 2-phenylazo-2,4-dimethyl-4-methoxyvaleronitrile and 2,2'-azobis(2-methylpropane).

The dialkyl peroxide polymerization initiators such as di-t-butyl peroxide, t-butyl cumyl peroxide and dicumyl peroxide are particularly preferred for use among these initiators.

The initiator is used in an amount of 0.05–5.0 parts by weight per 100 parts by weight of the vinyl monomer.

The solvent which is used in this invention is a compound having sufficient solubility for the vinyl monomer and its polymer. The solvent includes, for example, aliphatic hydrocarbons, aromatic hydrocarbons, esters, ethers, ketones, alcohols, cellosolves, carbitols, formamides and sulfamides. Above known solvent can be used singly or in combination. Particularly preferable solvent for this invention is xylene, ethylbenzene, benzene, toluene, ethyl acetate and Solvesso TM #100 and #150 (products of Esso Petroleum Co.).

The temperature for polymerizing the vinyl monomer is very important in the present invention. It is preferably in the range of 190°–230° C. and more preferably 200°–220° C. The polymerization temperature less than 190° C. is undesirable because the low molecular weight polymer cannot be obtained and the toner deteriorates the fixing ability. The temperature exceeding 230° C. is also undesirable because a relatively large amount of oligomer which is apparently the thermal reaction product of the monomer is generated as a by-product and the blocking resistance of the toner reduces.

The vinyl polymer which is used in this invention is obtained by polymerizing the aforesaid vinyl monomer and preferably contains styrene as the major ingredient. The number average molecular weight of the polymer is 1,000–5,000 and preferably 1,500–2,800. The number average molecular weight less than 1,000 is undesirable because the toner decreases the blocking resistance. That of more than 5,000 is also undesirable because the toner deteriorates the fixing ability.

The glass transition temperature of the vinyl polymer in this invention is preferably in the range of 40°–75° C. and more preferably 50°–70° C. The glass transition temperature of lower than 40° C. is undesirable because the toner decreases the blocking resistance. That of higher than 75° C. is also undesirable because the toner deteriorates the fixing ability.

The method for preparing the vinyl polymer by the solution polymerization will hereinafter be described in further detail. A homogeneous solution containing the vinyl monomer, solvent and polymerization initiator is continuously fed into a pressure reactor. The reactor was previously filled out with the solvent, heated to 130°–230° C. and kept the internal pressure constant. The polymerization is conducted in one step or multi steps. The discharge port of the pressure reactor is favorably equipped with a pressure regulating valve which operates by detecting the internal pressure in order to maintain the constant internal pressure.

In an alternative method, the homogeneous solution containing the vinyl polymer, solvent and polymerization initiator is continuously fed into a pressure reactor which was previously charged with a small amount of xylene solvent while maintaining the constant internal pressure. The feeding is terminated when the reactor is approximately filled up and the polymer solution obtained is discharged from the reactor.

The temperature around the discharge port may be maintained at the polymerization temperature or may be suddenly or slowly cooled to a relatively low temperature beneath the boiling point of solvent. When the polymerization temperature is maintained, the polymerized reaction mixture can be continuously flashed into a vacuum system of about 0–200 mmHg. The solvent is removed by this process and solid polymer can be obtained. When the temperature is lowered around the discharge port, the polymer can be obtained as a solution dissolved in a solvent mixture. The mean residence time of continuous polymerization in the reactor is normally 2–20 hours and depends upon the feeding rate of mixture containing the vinyl monomer, solvent and polymerization catalyst, and the effective volume of the reactor. These conditions can be selected so that the resulting polymerization ratio of the vinyl monomer is 80% and more, preferably 90% and more. Besides separated solvent can be recycled for the polymerization as it is or after distillation.

The above-mentioned vinyl polymer which is favorably used for the preparation of electrophotographic toner of this invention is also useful as a raw material for products other than the toner. Such products include, for example, styrene resin molding compositions. In order to prepare extrusion molding compositions, the aforesaid low molecular weight vinyl polymer is blended with styrene resin in a proportion ranging 0.5:99.5–20:80.

The resin which is advantageously used for this invention can be prepared, for example, by the below described methods, and yet is not restricted by these methods. That is, the aforesaid low molecular weight vinyl polymer is employed as solid or as a solution and uniformly mixed with the high molecular weight styrene containing polymer having a weight average molecular weight of, for example, in the range of 50,000–400,000. The polymers are preferably mixed in a ratio so that the low molecular weight vinyl polymer of this invention is contained in the range of 30–80% by weight. In order to remove unnecessary solvent, impurities, odor etc. from the vinyl polymer mixture thus obtained, the mixture can be subjected to a treatment at high temperatures under high vocuum to obtain solid resin. The use of vinyl polymer less than 30% by weight deteriorates the fixing ability and its use even more than 80% by weight causes difficulty in maintaining the toner strength and deteriorates apparent fixing ability. Besides use of other polymers such as insoluble and infusible crosslinked polymers is undesirable because of deterioration in the fixing ability.

Besides the most general method for preparing the electrophotographic toner of this invention is, for example, as follows. The aforesaid resin is ground to a size of about 0.5–2 mm and mixed with carbon black. The mixture obtained is optionally added with other polymer such as acrylic resin, coloring agent, magnetic powder, a small amount of charge control agent and wax. The resulting mixture is subjected to dispersion mixing with a Henshel mixer or a jet mill and then to melt kneading at a temperature of 130°–180° C. with a kneader. The mass thus obtained is crushed, finely ground and classified by air to obtain particles having a size of 5–25 μm.

The above-described toner, in the presence of magnetic powder, normally contains the resin in an amount of 10–99% by weight and more generally the toner contains 40% by weight of the magnetic powder and 60% by weight of the resin. In the absence of magnetic powder, the toner contains 50–99% by weight of the resin and more generally contains, for example, 5–10% by weight of carbon black and 95–90% by weight of the resin.

Other polymers which may be used in the preparation of the aforesaid electrophotographic toner include, for example, acrylic resin, styrene-acrylic resin, styrene-butadiene resin, styrene-maleic acid resin, polyamide resin, polyester resin, polyurethane resin, epoxy resin, cellulosic resin, maleated rosin and petroleum resin. In order to maintain the toner strength, high molecular weight polymer having Mw of not less than 100,000 is preferable in particular.

In addition, the coloring agent employed is pigments and dyestuffs, and includes, for example, carbon black, aniline blue, alcoyl blue, chrome yellow, ultramarine blue, quinoline yellow, methylene blue, phthalocyanine blue, malachite green, rose bengal and magnetite.

The charge regulator which may be used includes, for example, nigrosine, triphenylmethane dyestuffs, chrome complex of 3,5-di-t-butylsalicylic acid. Furthermore conventionally known additives such as colloidal silica, zinc stearate, low molecular weight polypropylene, polyethylene wax, polytetrafluoroethylene etc. may also be added if required.

Besides Mw and Mn respectively refers to the weight average molecular weight and the number average molecular weight. Mw and Mn are determined by separating the polymer in accordance with gel permeation chromatography (hereinafter abbreviated as GPC) using tetrahydrofuran (THF) as solvent, detecting with a differential refractometer (SHODEX SE-II) and calculating on the basis of the analytical curve of standard polystyrene. Mw and Mn are expressed as reduced values.

EXAMPLE 1

Half part of di-t-butylperoxide per 100 parts of styrene was solved in the mixture of 70 parts of styrene and 30 parts of xylene and ethylbenzene mixture. Thereafter, this solution was continuously fed to the reactor which is maintained the internal temperature of 190° C., the internal pressure of 6 kg/cm$^2$ and the discharge port temperature of 100° C. as a rate of 750 cc/hr to carry out polymerization.

The resulting styrene polymer had a conversion of 99.5% by weight and a number average molecular weight of 3,900 which was determined in accordance with GPC by using monodispersed standard polystyrene as a standard sample and tetrahydrofuran as a eluent.

Besides the solid polymer obtained by removing the solvent had a glass transition temperature of 70° C. which was measured with a differential scanning calorimeter by using alumina as a reference.

The low molecular weight styrene polymer having above properties was dissolved in xylene. The high molecular weight styrene polymer (II) consisting of 70 parts of styrene and 30 parts of n-butyl acrylate and having a weight average molecular weight of 300,000 and a glass transition temperature of 58° C. was also dissolved in xylene. Both xylene solutions were uniformly mixed so as to obtain an equal amount admixture of low molecular weight and high molecular weight polymers. The resulting mixture was treated at 190° C. under vacuum of 5 mmHg to remove the solvent. The resin thus obtained was solid at the room temperature.

To 100 parts of the resin above obtained, 7 parts of carbon black (MA-100, a product of Mitsubishi Chemical Co.), 2 parts of charge control agent (Spiron Black TRH, a product of Hodogaya Chemical Co.) and 5 parts of polypropylene wax (660P, a product of Sanyo Chemical Co.) were added. The resulting mixture was subjected to dispersion mixing with a Henshel mixer, and then to melt kneading at 160° C. with a twin screw kneader to obtain a toner mass. The mass was successively crushed to coarse particles having a size of about 1 mm, finely ground with a jet mill and classified with an air classifier to obtain toner particles having a size of 5–25 μm and a 50% average size of 11 μm. The toner thus obtained exhibited no blocking after standing for 8 hours under 55° C., and 80% relative humidity and had a good storage life.

Duplication Test

A two component electrophotographic developer was prepared by mixing 4 parts of above obtained toner, 100 parts of ferrite carrier (F-150, a product of Japan Iron Powder Co.) and 0.2 part of silica fine powder (Aerosil R972, a product of Japan Aerosil Co.) in a V-blender. A commercially available copying machine (EP870, a product of Minolta Camera Co.) was reformed so as to freely prescribe the hot roll temperature. The properties of the toner above obtained were examined by using the reformed machine. The minimum roll temperature which provides not less than 80% of fixation ratio (Note 1; hereinafter referred to as minimum fixation temperature) was very low (140° C.). On the other hand, no offset phenomenon was found up to 250° C. of roll temperature. Furthermore sharp, clean and good quality images could be obtained even after 30,000 sheets of duplication.

EXAMPLES 2–5

The same procedures as in Example 1 were carried out by using the monomer, polymerization initiator and solvent as illustrated in Table-1 and by conducting the polymerization at various temperatures as illustrated in Table-1. The resulting vinyl polymer had a number average molecular weight and glass transition temperature as illustrated in Table-1.

Toner was prepared from the polymer (I) thus obtained by carrying out the same procedures as in Example 1, and properties of the toner obtained are illustrated in Table-1.

As clearly understood from Table-1, the resulting toner was excellent in the blocking resistance, extremely low in the minimum fixation temperature and had a good fixing ability. Furthermore the offset phenomenon was not found up to a sufficiently high temperature. Sharp, clean and good quality images were obtained after 30,000 sheets of duplication.

REFERENCE EXAMPLES 1–2

The properties of polymer (I) obtained by polymerizing at relatively low temperatures and the performance of toner obtained from the polymer (I) by conducting the same procedures as in Example 1 are illustrated in Table-1.

The toner obtained by polymerizing at relatively low temperatures caused fogging (Note 2) during the duplication test of 5,000 sheets, apparently due to the use of polymerization initiator in a large quantity. The toner could not be employed for actual use.

In addition, the toner obtained by polymerizing at relatively high temperatures caused poor blocking resistance and at the same time led to fogging over 4,000 sheets of duplication, apparently due to the by-product generated by the thermal reaction among the monomer. Therefore the toner could not be employed for actual use.

EXAMPLES 6–9

The same procedures as in Example 1 were carried out by using the monomer, polymerization initiator and solvent as illustrated in Table-2 and by conducting the polymerization with different polymerization initiator as illustrated in Table-2. The resulting vinyl polymer had a number average molecular weight and glass transition temperature as illustrated in Table-2.

Toner was prepared from the polymer (I) thus obtained by carrying out the same procedures as in Example 1, and properties of the toner obtained are illustrated in Table-2.

As clearly understood from Table-2, the resulting toner was excellent in the blocking resistance, extremely low in the minimum fixation temperature and had a good fixing ability. Furthermore the offset phenomenon was not found up to a sufficiently high temperature. Sharp, clean and good quality images were obtained after 30,000 sheets of duplication.

REFERENCE EXAMPLES 3–4

The preparation conditions and properties of polymer (I) having a relatively high number average molecular weight and the performance of toner obtained from the polymer (I) by conducting the same procedures as in Example 1 are illustrated in Table-2.

As shown in Table-2, the toner prepared from the polymer having a relatively high number average molecular weight was high in the minimum fixation temperature and inferior in the fixing ability. When the number average molecular weight was too low, the toner had a poor offset and blocking resistance and caused fogging over the duplication of 2,000 sheets. The toner could not be employed for actual use.

EXAMPLES 10–13

The same procedures as in Example 1 were carried out by using the monomer, polymerization initiator and solvent as illustrated in Table-3 and by conducting the polymerization with different monomer and polymerization initiator as illustrated in Table-3. The resulting vinyl polymer had a number average molecular weight and glass transition temperature as illustrated in Table-3.

Toner was prepared from the polymer (I) thus obtained by carrying out the same procedures as in Example 1, and performance of the toner obtained are illustrated in Table-3.

As clearly understood from Table-3, the resulting toner was excellent in the blocking resistance, extremely low in the minimum fixation temperature and had a good fixing ability. Furthermore the offset phenomenon was not found up to a sufficiently high temperature. Sharp, clean and good quality images were obtained after 30,000 sheets of duplication.

REFERENCE EXAMPLES 5–6

The preparation conditions and properties of polymer (I) having a relatively low glass transition temperature and a relatively high glass transition temperature, as well as the performance of toner obtained from the polymer (I) by conducting the same procedures as in Example 1 are illustrated in Table-3.

The toner prepared from the polymer (I) having the relatively low glass transition temperature led to poor blocking resistance, low offset initiation temperature and fogging emergence during 1,000 sheets of duplication. The toner could not be employed for actual use.

When the glass transition temperature was relatively high, the toner was high in the minimum fixation temperature and inferior in the fixing ability.

EXAMPLES 14–18

The same procedures as in Example 1 were carried out by using the monomer, polymerization initiator and solvent as illustrated in Table-4 and by conducting the polymerization with different polymerization initiator and solvent as illustrated in Table-4. The vinyl polymer obtained had a number average molecular weight and glass transition temperature as illustrated in Table-4.

Toner was prepared from the polymer (I) thus obtained by carrying out the same procedures as in Example 1, and performance of the toner obtained are illustrated in Table-4.

As clearly understood from Table-4, the resulting toner was excellent in the blocking resistance, extremely low in the minimum fixation temperature and had a good fixing ability. Furthermore the offset phenomenon was not found up to a sufficiently high temperature. Sharp, clean and good quality images were obtained after 30,000 sheets of duplication.

EXAMPLES 19–20

The same procedures as in Example 1 were carried out by using the monomer, polymerization initiator and solvent as illustrated in Table-5. The vinyl polymer obtained had a number average molecular weight and glass transition temperature as illustrated in Table-5.

The same procedures as in Example 1 were carried out the polymer (I) thus obtained except the mixing ratio to the high molecular weight vinyl polymer (II) was varied. The performance of the toner obtained is illustrated in Table-5.

As clearly understood from Table-5, the resulting toner was excellent in the blocking resistance, extremely low in the minimum fixation temperature and had a good fixing ability. Furthermore the offset phenomenon was not found up to a sufficiently high temperature. Sharp, clean and good quality images were obtained after 30,000 sheets of duplication.

REFERENCE EXAMPLES 7–8

The same procedures as in Example 1 were carried out by using the polymer (I) illustrated in Table-5 except the above mixing ratio was relatively shifted. The performance of toner obtained is illustrated in Table-5.

When the proportion of polymer (I) in this invention was too small and caused mixing ratio displacement, the resulting toner was high in the minimum fixation temperature and had a poor in the fixing ability. When the proportion of polymer (I) was too large, the resulting toner was supposed to lack mechanical strengths. That is, in the wearing test of the finished images, the proportion of toner left on the copying paper was small and higher temperatures were required to obtain satisfactory fixation ratio. Consequently the fixing ability was poor.

TABLE 1

| | Example | | | | | Reference example | |
|---|---|---|---|---|---|---|---|
| No. | 1 | 2 | 3 | 4 | 5 | 1 | 2 |
| Monomer | | | | | | | |
| Styrene (part) | 70 | 70 | 70 | 70 | 70 | 70 | 70 |
| Methy methacrylate (part) | — | — | — | — | — | — | — |
| Methacrylic acid (part) | — | — | — | — | — | — | — |
| Butyl acrylate (part) | — | — | — | — | — | — | — |
| Polymer | | | | | | | |
| Solvent (part) | Xylene/Ethylbenzene 30 | ← | ← | ← | ← | ← | ← |
| Initiator (part) | D-t-BP 0.35 | ← | ← | ← | ← | D-t-BP 1.05 | D-t-BP 0.14 |
| Polymerization temp. (°C.) | 190 | 200 | 210 | 220 | 230 | 185 | 240 |
| Mn | 3,900 | 2,800 | 2,100 | 1,500 | 1,100 | 2,300 | 1,500 |
| Tg (°C.) | 70 | 66 | 57 | 50 | 45 | 57 | 43 |
| Polymer mixture ratio (I)/(II) | 50/50 | ← | ← | ← | ← | ← | ← |
| Toner | | | | | | | |
| Minimum fixation temp. (°C.) | 140 | 135 | 135 | 130 | 130 | 135 | 130 |
| Offset initiation temp. (°C.) | 250 | 250 | 250 | 245 | 230 | 250 | 245 |
| Blocking resistance | ⊙ | ⊙ | ⊙ | ⊙ | ⊙ | ⊙ | X |
| Image | Good | Good | Good | Good | Good | Fogging | Fogging |

Note:
D-t-BP = Di-t-butyl peroxide

TABLE 2

| | Example | | | | Reference Example | |
|---|---|---|---|---|---|---|
| No. | 6 | 7 | 8 | 9 | 3 | 4 |
| Monomer | | | | | | |
| Styrene (part) | 70 | 70 | 70 | 70 | 60 | 55 |
| Methy methacrylate (part) | — | — | — | — | — | — |
| Methacrylic acid (part) | — | — | — | — | — | — |

TABLE 2-continued

| | Example | | | | Reference Example | |
|---|---|---|---|---|---|---|
| No. | 6 | 7 | 8 | 9 | 3 | 4 |
| Butyl acrylate (part) | — | — | — | — | — | — |
| Polymer | | | | | | |
| Solvent (part) | Xylene/Ethyl-benzene 30 | ← | ← | ← | ← | ← |
| Initiator (part) | D-t-BP 4.6 | D-t-BP 2.1 | D-t-BP 0.14 | D-t-BP 0.05 | D-t-BP 0.014 | D-t-BP 10.5 |
| Polymerization temp. (°C.) | 210 | ← | ← | ← | ← | 230 |
| Mn | 1,200 | 1,600 | 2,800 | 4,600 | 5,500 | 950 |
| Tg (°C.) | 47 | 51 | 65 | 75 | 57 | 40 |
| Polymer mixture ratio (I)/(II) | 50/50 | ← | ← | ← | ← | ← |
| Toner | | | | | | |
| Minimum fixation temp. (°C.) | 130 | 135 | 135 | 145 | 160 | 130 |
| Offset initiation temp. (°C.) | 230 | 245 | 220 | 250 | 250 | 210 |
| Blocking resistance | ○ | ◎ | ◎ | ◎ | ◎ | X |
| Image | Good | Good | Good | Good | Good | Fogging |

TABLE 3

| | Example | | | | Reference Example | |
|---|---|---|---|---|---|---|
| No. | 10 | 11 | 12 | 13 | 5 | 6 |
| Monomer | | | | | | |
| Styrene (part) | 60 | 67 | 60 | 60 | 56 | 55 |
| Methy methacrylate (part) | 10 | — | 5 | — | — | — |
| Methacrylic acid (part) | — | 3 | 5 | — | — | 15 |
| Butyl acrylate (part) | — | — | — | 10 | 14 | — |
| Polymer | | | | | | |
| Solvent (part) | Xylene/Ethyl-benzene 30 | ← | ← | ← | ← | ← |
| Initiator (part) | D-t-BP 0.35 | ← | ← | D-t-BP 0.14 | D-t-BP 0.35 | D-t-BP 0.14 |
| Polymerization temp. (°C.) | 210 | ← | ← | ← | ← | ← |
| Mn | 2,200 | 2,000 | 2,100 | 4,000 | 2,200 | 2,400 |
| Tg (°C.) | 60 | 60 | 61 | 50 | 35 | 78 |
| Polymer mixture ratio (I)/(II) | 50/50 | ← | ← | ← | ← | ← |
| Toner | | | | | | |
| Minimum fixation temp. (°C.) | 135 | 135 | 135 | 135 | 130 | 160 |
| Offset initiation temp. (°C.) | 250 | 250 | 250 | 245 | 220 | 250 |
| Blocking resistance | ◎ | ◎ | ◎ | ○ | X | ◎ |
| Image | Good | Good | Good | Good | Fogging | Good |

TABLE 4

| | Example | | | | |
|---|---|---|---|---|---|
| No. | 14 | 15 | 16 | 17 | 18 |
| Monomer | | | | | |
| Styrene (part) | 70 | 70 | 70 | 70 | 70 |
| Methyl methacrylate (part) | — | — | — | — | — |
| Methacrylic acid (part) | — | — | — | — | — |
| Butyl acrylate (part) | — | — | — | — | — |
| Polymer | | | | | |
| Solvent (part) | Xylene/Ethyl-benzene 30 | ← | Toluene 30 | Xylene 30 | Ethylbenzene 30 |
| Initiator (part) | t-Butyl cumyl peroxide 0.35 | t-Butyl per-octoate 0.35 | Di-t-butyl peroxide 0.35 | ← | ← |
| Polymerization temp. (°C.) | 210 | ← | ← | ← | ← |
| Mn | 2,100 | 2,200 | 2,200 | 2,100 | 2,100 |
| Tg (°C.) | 58 | 52 | 58 | 58 | 57 |
| Polymer mixture ratio (I)/(II) | 50/50 | ← | ← | ← | ← |
| Toner | | | | | |
| Minimum fixation temp. (°C.) | 135 | ← | ← | ← | ← |
| Offset initiation temp. (°C.) | 250 | ← | ← | ← | ← |
| Blocking resistance | ◎ | ○ | ◎ | ◎ | ◎ |
| Image | Good | Good | Good | Good | Good |

TABLE 4

| | Example | | Reference Example | |
|---|---|---|---|---|
| No. | 19 | 20 | 7 | 8 |
| Monomer | | | | |
| Styrene (part) | 70 | 70 | 70 | 70 |

TABLE 4-continued

| No. | Example 19 | Example 20 | Reference Example 7 | Reference Example 8 |
|---|---|---|---|---|
| Methyl methacrylate (part) | — | — | — | — |
| Methacrylic acid (part) | — | — | — | — |
| Butyl acrylate (part) | — | — | — | — |
| Polymer | | | | |
| Solvent (part) | Xylene/Ethylbenzene 30 | ← | ← | ← |
| Initiator (part) | D-t-BP 0.35 | ← | ← | ← |
| Polymerization temp. (°C.) | 210 | ← | ← | ← |
| Mn | 2,100 | ← | ← | ← |
| Tg (°C.) | 57 | ← | ← | ← |
| Polymer mixture ratio (I)/(II) | 30/70 | 80/20 | 20/80 | 90/10 |
| Toner | | | | |
| Minimum fixation temp. (°C.) | 145 | 140 | 160 | 160 |
| Offset initiation temp. (°C.) | 250 | 230 | 250 | 200 |
| Blocking resistance | ◎ | ◎ | ◎ | ◎ |
| Image | Good | Good | Good | Good |

(Note 1) Fixing ability of the toner was evaluated as follows. An image of solid black part on a duplicated paper having a dimension of 2×2 cm is used as a specimen. Gakushin Model Friction Fastness Tester (a product of Taiei Manufacturing Co.) was used for the examination. The toner layer on the specimen was rubbed with a sanded rubber eraser 50 times under a load of 125 g/cm$^2$. The residual amount of toner layer after rubbing was measured. The lowest roll temperature required to obtain more than 80% by weight of the residual toner was defined as the minimum fixation temperature.

(Note 2) Fogging means the following phenomenon. Fine particles of the toner was found to adhere on the white part of duplicate. The distinction between tonered and non-tonered parts was lost and sharpness of the image was deteriorated.

(Note 3) Blocking resistance was evaluated by observing the aggregation after allowing to stand the toner for 8 hours at the temperature of 55° C. under 80% relative humidity. Results were divided into the following four classes.

| | |
|---|---|
| ◎ | No aggregation was found at all. |
| ○ | Aggregation was found partially but easily unfastened. |
| Δ | Firm coagulate was found in part. |
| X | Firm coagulate was found entirely. |

As mentioned above, the present invention can provide sharp, clean and good quality images having an excellent fixing ability at a high duplication speed and lower temperatures. Such fixing ability has not yet been achieved by the conventional technology. This invention can also provide electrophotographic toner having excellent blocking and offset resistance.

What is claimed is:

1. An electrophotographic toner which comprises containing 30–80% by weight of a polymer per total weight of a resin included in the toner, said polymer being obtained by continuously feeding a vinyl monomer, a polymerization initiator and a solvent into a system of 190°–230° C. to conduct polymerization under a liquid state, and said polymer being a vinyl polymer having a number average molecular weight of 1,000–5,000 and a glass transition temperature of 40°–75° C.

2. The toner as claimed in claim 1 wherein the polymer has a number average molecular weight of 1,500–2,800.

3. The toner as claimed in claim 1 wherein the polymer has a glass transition temperature of 50°–75° C.

4. The toner as claimed in claim 1 wherein the vinyl monomer for constituting the polymer is styrene alone or a mixture of styrene with methyl methacrylate and/or methacrylic acid.

5. The toner as claimed in claim 1 wherein the polymerization initiator is dialkyl peroxide.

6. The toner as claimed in claim 5 wherein amount of the polymerization initiator is 0.05–5.0 parts by weight per 100 parts by weight of the vinyl monomer.

7. A preparation method of a vinyl polymer having a number average molecular weight of 1,000–5,000 and a glass transition temperature of 40°–75° C. which comprises conducting polymerization of a vinyl monomer in a state of solution at a temperature of 190°–230° C.

8. The preparation method as claimed in claim 7 wherein a polymerization initiator is used in an amount of 0.05–5.0 parts by weight per 100 parts by weight of the vinyl monomer in the reaction.

9. The preparation method as claimed in claim 7 wherein the vinyl monomer is styrene alone or a mixture of styrene with methyl methacrylate and/or methacrylic acid.

10. The preparation method as claimed in claim 7 wherein the polymerization initiator is dialkyl peroxide.

11. The preparation method as claimed in claim 7 wherein solvent is removed after polymerization by flashing the resulting solution into a vacuum system.

12. The preparation method as claimed in claim 7 wherein a separated and recovered solvent is recycled as the solvent.

13. The toner as claimed in claim 1 wherein the vinyl monomer for constituting polymer consists essentially of styrene.

14. The toner as claimed in claim 1 wherein the vinyl monomer for constituting the polymer consists essentially of styrene and methylmethacrylate.

15. The preparation method as claimed in claim 7 wherein the vinyl monomer consists essentially of styrene.

16. The preparation method of claim 7 wherein the vinyl monomer consists essentially of styrene and methylmethacrylate.

* * * * *